US008763596B2

(12) United States Patent
Lam

(10) Patent No.: US 8,763,596 B2
(45) Date of Patent: Jul. 1, 2014

(54) CARTRIDGE FOR LAUNCHING A BULLET

(75) Inventor: Chung Ho Lam, Tsuen Wan (HK)

(73) Assignee: APS Ltd., Hong Kong (HK)

( * ) Notice: Subject to any disclaimer, the term of this patent is extended or adjusted under 35 U.S.C. 154(b) by 0 days.

(21) Appl. No.: 13/612,899

(22) Filed: Sep. 13, 2012

(65) Prior Publication Data

US 2013/0231205 A1 Sep. 5, 2013

(30) Foreign Application Priority Data

Mar. 1, 2012 (HK) ..... 12102140

(51) Int. Cl.
*F41B 11/00* (2013.01)
*F42B 8/12* (2006.01)
*F42B 6/10* (2006.01)

(52) U.S. Cl.
USPC ..... 124/57; 102/439; 102/440; 102/444

(58) Field of Classification Search
USPC ..... 102/293, 430, 439, 440, 444, 446, 447, 102/464; 124/57, 58, 61, 65
See application file for complete search history.

(56) References Cited

U.S. PATENT DOCUMENTS 1,860,276 A * 5/1932 De Luce et al. ..... 89/14.2
2,327,653 A * 8/1943 Lisle ..... 124/57
3,045,659 A * 7/1962 Malcolm ..... 124/57
3,717,947 A * 2/1973 Nomura ..... 43/19
4,404,765 A * 9/1983 Reudelsterz et al. ..... 42/77
4,531,458 A * 7/1985 Saxby ..... 102/440
4,539,969 A * 9/1985 Saxby ..... 124/57
4,697,523 A * 10/1987 Saxby ..... 102/440
5,187,323 A * 2/1993 Saxby ..... 102/440
5,349,938 A * 9/1994 Farrell ..... 124/73
5,700,972 A * 12/1997 Saxby ..... 102/440
5,962,805 A * 10/1999 Saxby ..... 102/440
6,095,051 A * 8/2000 Saxby ..... 102/444
6,145,440 A * 11/2000 Franzen ..... 102/446
6,415,718 B1 * 7/2002 Saxby ..... 102/446
6,422,149 B1 * 7/2002 Saxby ..... 102/446
7,814,836 B2 * 10/2010 Saxby ..... 102/444
8,256,406 B1 * 9/2012 Kirkpatrick ..... 124/73
8,365,669 B1 * 2/2013 Saxby ..... 102/430
8,448,632 B2 * 5/2013 Ma ..... 124/73
2002/0162475 A1 * 11/2002 Saxby ..... 102/446
2007/0017406 A1 * 1/2007 Tippmann, Jr. ..... 102/440
2009/0211482 A1 * 8/2009 Saxby ..... 102/430
2010/0269724 A1 * 10/2010 Head et al. ..... 102/447

* cited by examiner

*Primary Examiner* — Bret Hayes
*Assistant Examiner* — Derrick Morgan

(57) ABSTRACT

A cartridge for launching a bullet, includes a shell case, a pressure chamber and a push rod; the shell case defines concentric through-holes; the pressure chamber is set up between the through-holes; the push rod defines an air vent and an airway, the air vent being in fluid communication with the firing chamber via the airway; a piston is mounted to the push rod and is received in the pressure chamber for compressing the chamber; when uncompressed, the air vent is located in the pressure chamber, when the push rod is struck the air vent moves forwards, back into the pressure chamber, the compressed air in the pressure chamber is discharged via the air vent and the airway to fire the bullet. The invention has a simple and compact structure, and is safe in use.

4 Claims, 2 Drawing Sheets

CARTRIDGE FOR LAUNCHING A BULLET

FIELD OF THE INVENTION

The present invention relates to a cartridge for launching a bullet.

BACKGROUND OF THE INVENTION

In almost all of the current inflatable bullets, gas follows in straight path and the close and open of the air flow is controlled by a gas check. For the reason that the gas check is easily being vibrated or being contacted in error, the bullet can be easily fired in error, thus leading to safety problem.

SUMMARY OF THE INVENTION

This present invention provides an inflatable bullets which solves the problems that the traditional inflatable bullets are easily being contacted in error, being fired in error and are in poor security.

In order to realize the object mentioned above, the technical schemes as followed are adopted.

An inflatable bullet, including a shell case, a pressure chamber and a push rod; the shell case includes a front part and a back part, and the shell case front part has an interference connection with a front end of the shell case back part, and centers of the two parts have concentric through-holes; the pressure chamber, consisting of a pressure chamber cavity and pressure chamber caps at two ends, is set up between the through-holes of the shell case front part and back part; the push rod passes through the pressure chamber and an air vent ventilating with the outside via an airway is set up in the middle of the push rod; when uninflated, the air vent is located in the pressure chamber, and a piston is set up in the middle of the push rod, which is positioned at front of the air vent in the pressure chamber.

Optionally, a groove is set up at the junction of the shell case front part and back part, and a seal ring is installed inside the groove; seal rings are set up at outer sides of the two pressure chamber caps and at the contact point of the shell case and the push rod. The invention has a simple and compact structure, and because air flows laterally through the air vent on the push rod, even through air leakage occurs in the use, bullets would not be fired in error, effectively increasing the safety of inflatable bullets; the material of the pressure chamber cavity and the shell case is aluminum while the material of the pressure chamber and the piston is iron; and the push rod is made of steel; when inflating the pressure chamber though the airway of the push rod from the front part of the push rod, the air pressure will push the push rod to move backwards until the air vent on the push rod is pushed out of the pressure chamber, when it forms a certain pressure in the pressure chamber, when to fire the bullet, strike the rear end of the push rod by using a firing pin to make the air vent of the push rod back into the pressure chamber, the pressure inside the pressure chamber pushes the piston which further push the push rod forward.

The invention has a simple and compact structure, by setting an air vent both on the push rod and inside the pressure chamber as well as setting the piston behind the air vent; when inflating the inflatable bullets, the push rod will be made to move backwards until the air vent is pushed out of the pressure chamber, and the pressure chamber becomes no longer ventilating with the outside; when to fire the bullet, strike the rear end of the push rod by a firing pin and the air vent on the push rod will be pushed back into the pressure chamber, thus, the pressure inside the pressure chamber will make the push rod move by pushing the piston, making the bullet inside the firing chamber which is deposited on the shell case front part be fired by the push rod; for the reason that the air flows laterally though the air vent on the push rod, even though air leakage occurs in the use, air will vent though the contact point of the pressure chamber cavity and the pressure chamber caps, so bullets would not be fired in error, thus effectively increasing the safety of the inflatable bullets.

1, shell case back part; 11, back part through-holes; 2, push rod; 21, air vent; 22, airway; 3, seal ring; 4, pressure chamber caps; 5, pressure chamber cavity; 6, piston; 7, shell case front part; 71, front part through-holes; 72, Firing chamber; 8, pressure chamber.

DETAILED DESCRIPTION OF THE PREFERRED EMBODIMENT

Figure 1:
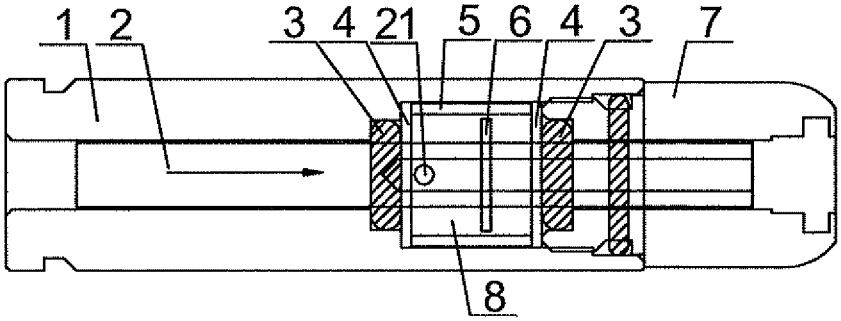
FIG. 1 is an overall structural representation of the uninflated inflatable bullet of the present invention.

Referring to FIG. 1, it provides one embodiment of the present invention.

The cartridge in the embodiment includes a shell case, a pressure chamber 8 and a push rod 2; the shell case includes a shell case front part 7 and a shell case back part 1, and the shell case front part 7 has an interference connection with a front end of the shell case back part 1, and centers of the two parts have concentric through-holes, that is back part through-holes 71 and front part through-holes 11; the pressure chamber 8, consisting of a pressure chamber cavity 5 and pressure chamber caps 4 at two ends, is set up between the through-holes of the shell case front part 71 and the shell case back part 1; the push rod 2 passes through the pressure chamber 8 and an air vent 21 in fluid communication with a firing chamber 72, defined at an end of the shell case front part 7 away from the shell case back part 1, via an airway 22 is set up in the middle of the push rod 2; when uncompressed, the air vent 21 is located in the pressure chamber 8, and a piston 6 is set up in the middle of the push rod 2, which is positioned at front of the air vent 21 in the pressure chamber 8; a groove is set up at the junction of the shell case front part 7 and shell case back part 1, and a seal ring 3 is installed inside the groove; seal rings 3 are also set up at outer sides of the two pressure chamber caps 4 and at the contact point of the shell case and the push rod 2; the material of the pressure chamber

8 and the shell case is aluminum while the material of the pressure chamber caps 4 and the piston 6 is iron; and the push rod 2 is made of steel.

Figure 2:
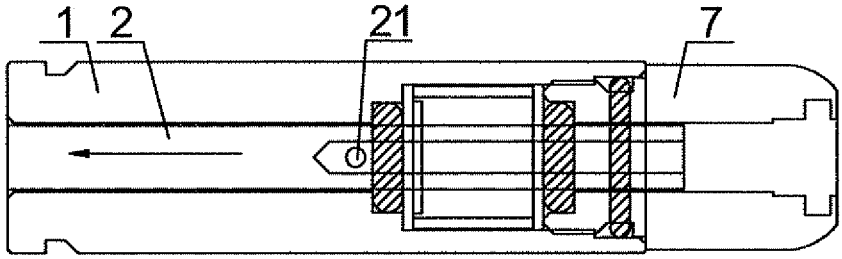
FIG. 2 is a structural representation of the fully inflated inflatable bullet of the present invention.
Figure 3:
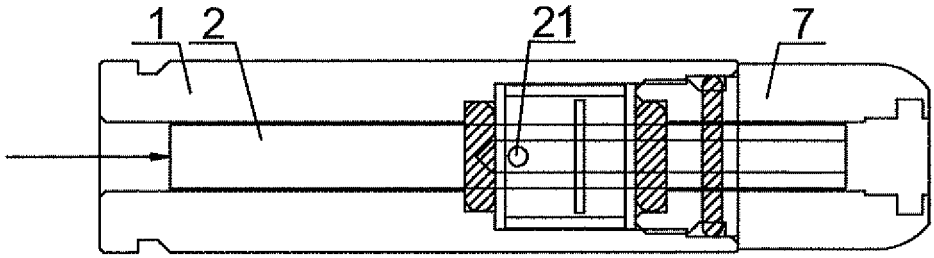
FIG. 3 is a schematic diagram of the inflatable bullet when being deflated.
Figure 4:
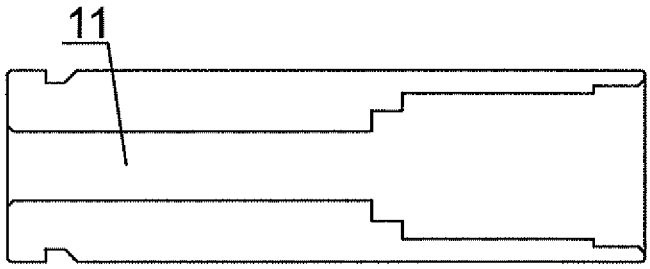
FIG. 4 is a structural representation of the component 1 shown in FIG. 1.
Figure 5:
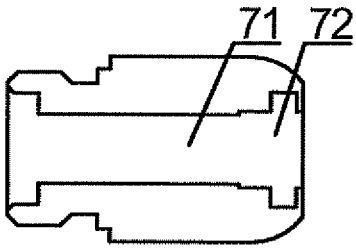
FIG. 5 is the structural representation of the component 7 shown in FIG. 1.
Figure 6:
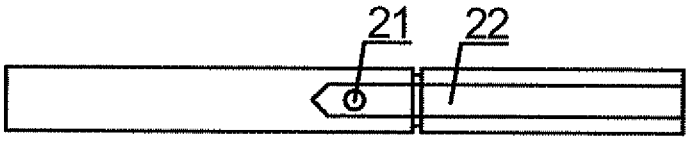
FIG. 6 is the structural representation of the component 2 shown in FIG. 1.
Figure 7:
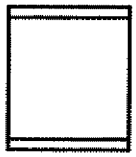
FIG. 7 is a structural representation of the component 5 shown in FIG. 1.
Figure 8:
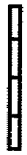
FIG. 8 is a structural representation of the component 4 shown in FIG. 1
Figure 9:
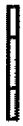
FIG. 9 is a structural representation of the component 6 shown in FIG. 1.

FIG. 1 illustrates the overall structural representation of the uncompressed cartridge; FIG. 2 illustrates the structural representation of the fully compressed cartridge; FIG. 3 illustrates the schematic diagram of the cartridge when being fired by deflating gas, the principle and process are: when compressing the pressure chamber 8 though the airway 22 of the push rod 2 from the front part of the push rod, the air pressure will push the push rod 2 to move backwards until the air vent 21 on the push rod 2 is pushed out of the pressure chamber 8, when it forms a certain pressure in the pressure chamber 8; to fire the bullet ,strike the rear end of the push rod 2 with a firing pin to make push rod 2 move forwards, causing the air vent 21 to move back into the pressure chamber 8, the pressure inside the pressure chamber 8 pushes the piston 6 which further pushes the push rod 2 forward.

The invention has a simple and compact structure, by setting an air vent 21 both on the push rod 2 and inside the pressure chamber 8, as well as setting the piston 6 at the rear end of the air vent 21. The cartridge is charged with pressured air from a CO2 canister. The pressured air is compressed into the cartridge via firing chamber 72, before the projectile is inserted into the firing chamber. When compressing the cartridge, the push rod 2 will be pushed backwards until the air vent 21 is pushed out of the pressure chamber 8, at which point the pressure chamber 8 will no longer be in fluid communication with the firing chamber; to fire the bullet, strike the rear end of the push rod 2 with a firing pin so that the air vent 21 on the push rod 2 will be pushed forwards, back into the pressure chamber 8, thus, the air pressure inside the pressure chamber 8 will make the push rod 2 move by pushing the piston 6, making the bullet inside the firing chamber 72 which is deposited on the shell case front part be fired by the push rod 2; for the reason that the air flows laterally though the air vent 21 on the push rod 2 ,even though air leakage occurs in the use ,air will vent though the contact point of the pressure chamber cavity 5 and the pressure chamber caps 4, so bullets would not be fired in error by the air vent 21 on the push rod ,thus effectively increasing the safety of the cartridge.

The invention claimed is:

1. A cartridge for launching a bullet, including a shell case, a pressure chamber and a push rod, wherein, the shell case comprises a shell case front part and a shell case back part, and centers of the shell case front part and the shell case back part define concentric through-holes;

wherein a firing chamber for receiving the bullet is defined at an end of shell case front part away from the shell case back part and communicates with the through-holes;

wherein the pressure chamber is set up between the through-holes of the shell case front part and the shell case back part;

wherein the push rod passes through the pressure chamber;

wherein the push rod defines an air vent and an airway, the air vent being in fluid communication with the firing chamber via the airway;

wherein a piston is mounted to the push rod and is received in the pressure chamber for compressing air in the pressure chamber;

when the cartridge is uncompressed, the air vent is located in the pressure chamber, and the piston is between the air vent and the firing chamber;

when air is compressed into the cardtridge, the push rod slides away from the firing chamber, pushing the air vent out of the pressure chamber, and the piston compresses air in the pressure chamber;

when an end of the push rod away from the firing chamber is struck to make the air vent move forwards, back into the pressure chamber, the compressed air in the pressure chamber is discharged via the air vent and the airway to fire the bullet received in the firing chamber; and wherein the piston is slidably received in the pressure chamber, and divides the pressure chamber into two sealed spaces.

2. The cartridge of claim 1, wherein one of the sealed spaces away from the firing chamber communicates with the firing chamber via the air vent and the airway when the cartridge is uncompressed.

3. The cartridge of claim 1, wherein when the push rod slides away from the firing chamber, the piston compresses the one of the sealed space away from the firing chamber, and the air vent is out of the one of the sealed space away from the firing chamber.

4. The cartridge of claim 3, wherein when an end of the push rod away from the firing chamber is struck, the air vent moves forwards, into the one of the sealed spaces away from the firing chamber, and the compressed air in the one of the sealed spaces away from the firing chamber is discharged via the air vent and the airway to fire the bullet received in the firing chamber.

* * * * *